United States Patent [19]

Orosa

[11] 4,254,992

[45] Mar. 10, 1981

[54] KNOCKDOWN RATTAN CHAIR

[76] Inventor: Jose S. Orosa, P.O. Box 456 MCC, Makati, Metro Manila 3117, Philippines

[21] Appl. No.: 1,713

[22] Filed: Jan. 8, 1979

[51] Int. Cl.[3] ..... A47C 4/02

[52] U.S. Cl. ..... 297/440; 297/443; 297/134; 297/239

[58] Field of Search ..... 297/130, 134, 239, 440, 297/443

[56] References Cited

U.S. PATENT DOCUMENTS

| | | | |
|---|---|---|---|
| 434,713 | 8/1890 | Jacob | 297/134 X |
| 2,530,474 | 11/1950 | Lutes | 297/134 X |
| 2,560,708 | 7/1951 | Titus | 297/134 X |
| 2,574,289 | 11/1951 | Rossi | 297/134 |
| 3,504,942 | 4/1970 | Wong | 297/440 X |

FOREIGN PATENT DOCUMENTS

| | | | |
|---|---|---|---|
| 9683 | of 1896 | United Kingdom | 297/134 |

*Primary Examiner*—Francis K. Zugel

*Attorney, Agent, or Firm*—Mark T. Basseches; Paula T. Basseches

[57] ABSTRACT

A knockdown rattan chair formed by a separate and nestable preformed seat member and a nestable preformed back member which includes a back rest and arm rests. The circular base of the back member is dimensioned to snugly encompass the upper circular frame of the seat member in abutting relation with each other, and fixedly secured thereto by spaced dowel pins disposed peripherally thereon.

1 Claim, 4 Drawing Figures

KNOCKDOWN RATTAN CHAIR

This invention generally relates to rattan furniture constructions and more particularly to a knockdown rattan chair.

Heretofore, rattan furnitures are rigidly assembled as a unitary structure by tightly binding together the rattan components by the use of rattan binding stripe. These rattan furnitures, usually are so artistically designed that it occupies a lot of space during handling and when in transit from one place to another.

To cut down packaging and transportation costs, the present design of furniture articles is directed towards knockdown and demountable types which are space savers.

This present invention seeks to overcome the inherent drawbacks of rattan furnitures attributed to the bulkiness due to the irregular shapes.

Accordingly, it is the most important object of this invention to provide a knockdown rattan chair formed of easily separable preformed seat member and back member, each being adapted to be in nestable relation with each other.

A specific object of this invention is to provide a knockdown rattan chair wherein the separate preformed seat member and back member are rigidly connected together by the use of dowel pins.

A further specific object of this invention is to provide a knockdown rattan chair wherein the seat member could also be used as a coffee table or the like.

A still further object is to provide a knockdown rattan chair which is simplified in structure, ease to assemble, elegant in style and durable.

Since the chair preformed members are nestable, it could be reduced into a very compact form to facilitate packaging. This makes the item ideal for export purposes.

The above and other specific objects and advantages of this invention will become apparent from the following description when read in conjunction with the accompanying drawings wherein.

Figure 2:
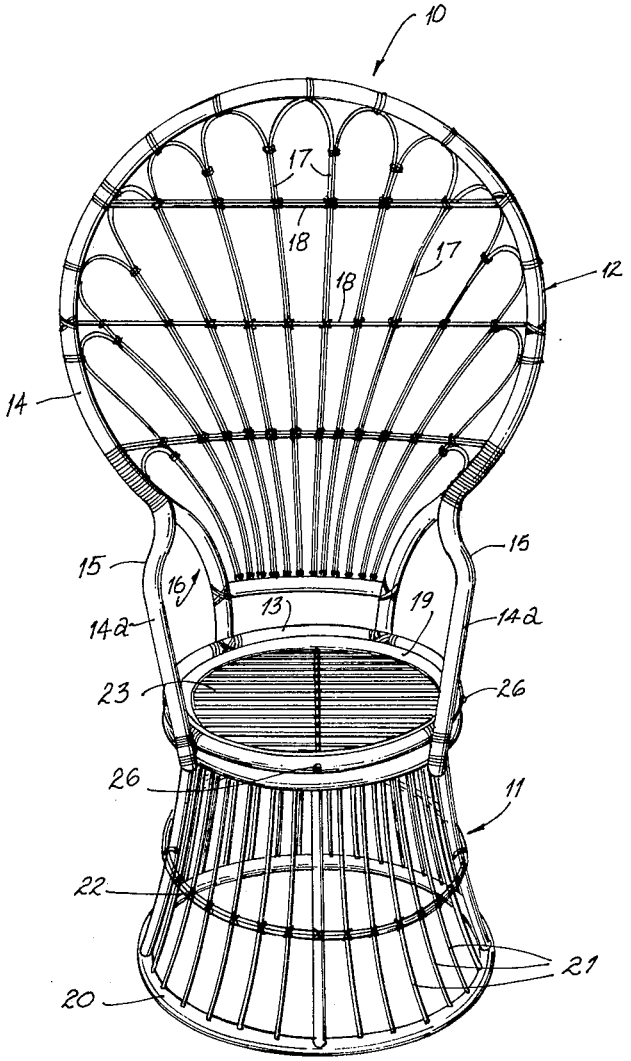
FIG. 2 is a front perspective view of FIG. 1 in its assembled condition.

Referring now to the drawings in detail, there is shown in FIG. 2 an assembled knockdown rattan chair indicated in its entirety as 10.

Figure 1:
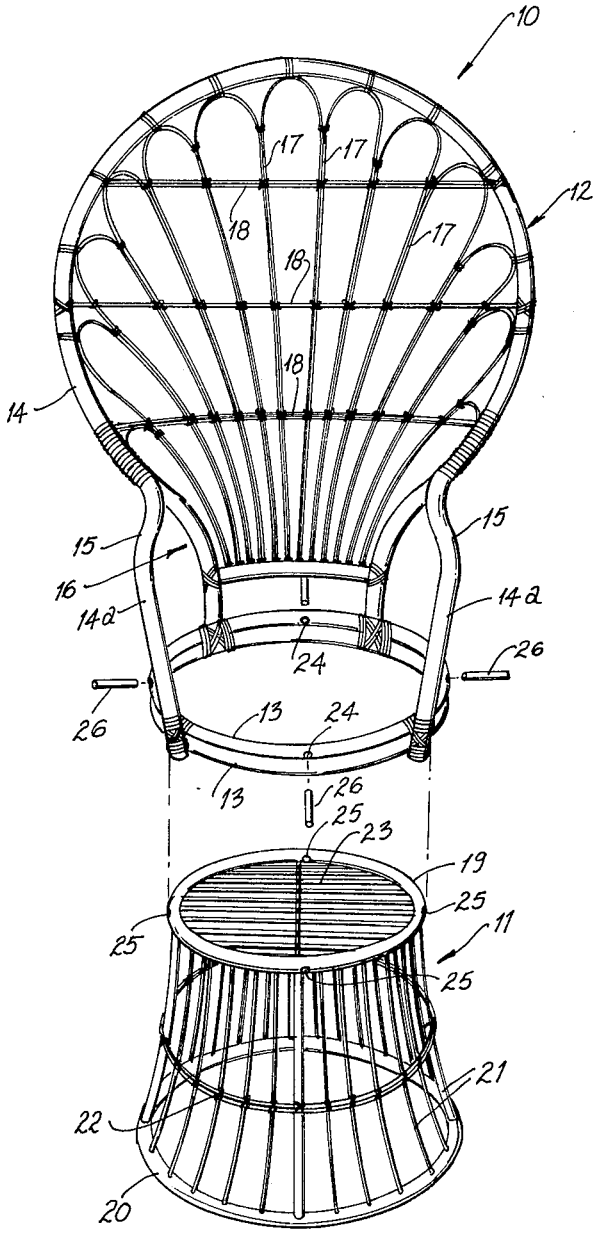
FIG. 1 is an exploded perspective view of a knockdown rattan chair constructed in accordance with this invention.

As best shown in FIG. 1, said rattan chair 10 comprises a separate preformed seat member 11 and a separate preformed back member 12 which is detachably superposed on said seat member.

The back member 12 comprises two superposed circular base 13 and a substantially circular back frame 14 which includes the opposed arm rests 15 formed by the arcuate extensions 14*a*, and a back rest 16 formed by the looped ribs 17 and the transversely disposed reinforcing ribs 18, said arm rests and back rest of which are fixedly secured to said circular base 13.

The seat member 11 comprises a horizontally disposed upper frame 19 of circular shape and a similarly disposed circular base frame 20 which is relatively bigger in diameter than said upper frame 19. Fixedly interconnecting said upper frame 19 and said base frame 20 are the vertical ribs 21 reinforced by the intermediate circular braces 22. The upper circular frame is fixedly secured thereon closedly spaced slats 23 to form the load bearing surface.

As best shown in FIG. 1, the circular base 13 of the back member 12 is dimensioned to snugly encompass the upper circular frame 19 of the seat member 11. Horizontally aligned holes 24 and 25 are provided on said circular base 13 and circular frame 19, respectively, to snugly fit therein the dowel pins 26.

All the chair components and the binding strips except, the dowel pins 26 are formed purely of rattan.

Figure 3:
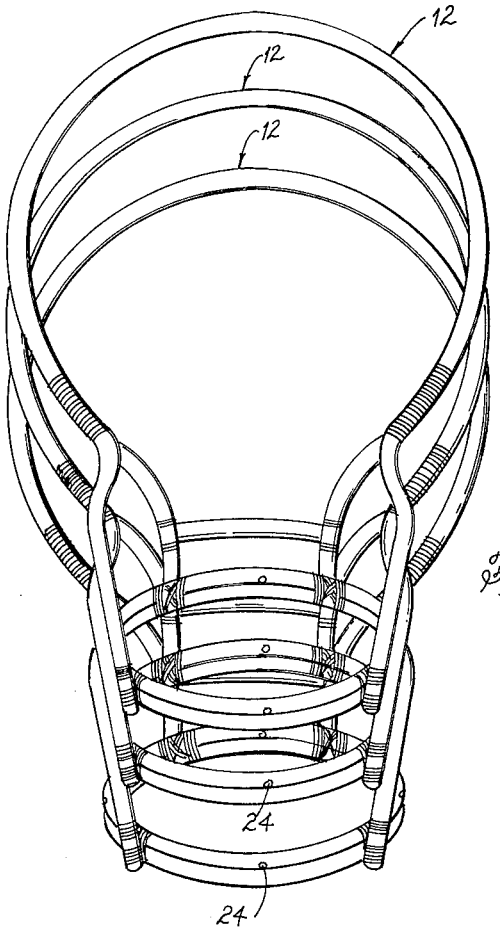
FIG. 3 is a view illustrating the nestable relation of several back members of the knockdown rattan chair.
Figure 4:
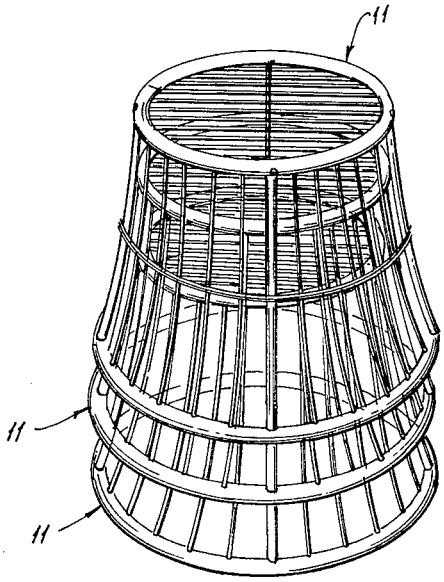
FIG. 4 is a view similar to FIG. 3 illustrating the nestable relation of several seat members.

It is herein shown that the rattan chair 10 is of a knockdown construction for handling, storage and transportation purposes. As illustrated in FIGS. 3 and 4, the seat members 11 and the back members 12 are separately nested to form separate packages, when stored or transported. Preferably, as substantially cylindrical container maybe of best use in packaging said chair members.

What is claimed is:

1. As a new article of manufacture, a plurality of knockdown rattan chairs, each comprised of a preformed seat member and a preformed back member, a plurality of said seat members and a plurality of said back members being nested in stacks for shipping, said seat members each having an upper circular frame and a circular base of greater diameter than said frame, said base and frame being interconnected by vertical ribs and reenforced by an intermediate circular base, said ribs being disposed in converging direction from said base frame to said upper frame, said plurality of seat members being nested in mutually partially overlapping relation to define said stack, the total height of which is less than the combined heights of the unnested seat members, a plurality of preformed back members made of rattan, each adapted to be detachably superimposed on a said seat member, said back members each having a circular base and a back frame of substantially circular shape defining a back rest and opposed arm rests fixedly secured on said circular base, said arm rests of said back members converging in the direction of said circular bases of said back members, said plurality of back members being nested in mutually partially overlapped relation to define a composite stack the total height of which is less than the combined height of said back members, said circular base of said back members being dimensioned snugly to encompass the upper circular frame of said seat members, said upper frames of said seat members and said circular bases of said back members each having a plurality of spaced holes adapted to be disposed in horizontal alignment with each other when said upper frames are disposed within said circular bases, and a plurality of dowel pins sized to be detachably and snugly fitted in each of said aligned holes whereby a said seat member from said nested stack and a said back member from said nested stack may be rigidly connected with each her.

* * * * *